US008777651B2

(12) United States Patent
Miyawaki

(10) Patent No.: US 8,777,651 B2
(45) Date of Patent: Jul. 15, 2014

(54) CONNECTOR

(75) Inventor: Koji Miyawaki, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 102 days.

(21) Appl. No.: 13/541,321

(22) Filed: Jul. 3, 2012

(65) Prior Publication Data

US 2013/0029516 A1 Jan. 31, 2013

(30) Foreign Application Priority Data

Jul. 27, 2011 (JP) ..... 2011-164624

(51) Int. Cl.
*H01R 13/627* (2006.01)

(52) U.S. Cl.
USPC ..... 439/354

(58) Field of Classification Search
USPC ..... 439/351, 354, 358, 357
See application file for complete search history.

(56) References Cited

U.S. PATENT DOCUMENTS

| | | | | |
|---|---|---|---|---|
| 4,986,766 | A * | 1/1991 | Leonard et al. | 439/352 |
| 5,219,300 | A * | 6/1993 | Yagi et al. | 439/352 |
| 5,254,014 | A | 10/1993 | Yagi et al. | |
| 5,295,855 | A * | 3/1994 | Walz | 439/354 |
| 5,664,961 | A | 9/1997 | Tsuji et al. | |
| 6,027,359 | A | 2/2000 | Aoki et al. | |
| 6,364,685 | B1 * | 4/2002 | Manning | 439/357 |
| 7,229,306 | B2 * | 6/2007 | Mase et al. | 439/354 |
| 2006/0025004 | A1 * | 2/2006 | Chen | 439/354 |

FOREIGN PATENT DOCUMENTS

| | | | |
|---|---|---|---|
| CN | 1332894 | A | 1/2002 |
| JP | 7-220807 | A | 8/1995 |
| JP | 10-112355 | A | 4/1998 |
| WO | 00/36709 | A2 | 6/2000 |

OTHER PUBLICATIONS

Chinese Office Action for the related Chinese Patent Application No. 201210260638 dated May 4, 2014.

* cited by examiner

*Primary Examiner* — Phuong Dinh
(74) *Attorney, Agent, or Firm* — Kenealy Vaidya LLP

(57) ABSTRACT

There is provided a connector. A lock arm is connected at a leading end-side and a rear end-side of a housing, supported at both ends thereof along an insertion/pulling out direction with respect to an opposite connector housing, and elastically deformable with the connection parts with the housing serving as fulcrums. A locking claw is formed at the lock arm and locked into a locking hole of the opposite connector housing when inserting the housing into the opposite connector housing. The lock arm has a lock release part which releases a locked state of the locking claw to the locking hole by being pressed toward the rear end-side beyond the locking claw. A position of the fulcrum at the rear end-side is arranged at an opposite side to a protruding direction of the locking claw, compared to a position of the fulcrum at the leading end-side.

3 Claims, 7 Drawing Sheets

CONNECTOR

The disclosure of Japanese Patent Application No. 2011-164624 filed on Jul. 27, 2011, including specification, drawings and claims is incorporated herein by reference in its entirety.

BACKGROUND

The invention relates to a connector that is inserted to and pulled out from an opposite connector.

As shown in FIG. 10, a lock-mounted connector has been known which has, at an upper part thereof, a locking protrusion 1 of locking a locking opening of an opposite connector housing and a lock release part 2 for releasing a locked state with the opposite connector housing and in which a lock arm 4 of a both ends-supported structure having front and rear end portions fixed on a connector housing 3 is provided on one outer wall surface of the connector housing 3 (for example, refer to Patent Document 1).

In the above connector, the rear end portion of the lock arm 4 is folded back to form a band part 5, and when releasing the locked state by an elastic operation of the band part 5, a pressing force of the lock release part 2 is decreased and a pressing load applied to a rear support part of the lock arm 4 is also decreased, so that the deformation or damage of the rear support part is suppressed.

Patent Document 1: JP-A-7-220807

However, the pressing force applied from a finger pressing the lock release part 2 is applied to a front side (an arrow A direction in FIG. 10) that is inclined relative to the connector housing 3.

Compared to this, when the lock release part 2 is pressed as shown in FIG. 11, the lock arm 4 is elastically deformed so that a central portion thereof is downward bent with a connection part 4*a* of the leading end side thereof and a bent portion 5*a* of the band part 5 located at a substantially horizontal position relative to the connection part 4*a* serving as fulcrums. Thereby, the lock release part 2 is displaced toward a rear side (an arrow B direction in FIG. 10) that is inclined relative to the connector housing 3.

Like this, according to the above connector, the displacement directions of the lock release part 2 are different depending on the directions of the pressing force applied from the finger when releasing the locked state. Hence, the pressing force is not efficiently transferred to the lock arm 4 when releasing the locked state, so that it is difficult to smoothly release the locked state.

Also, the lock arm having a general cantilever structure can be easily elastically deformed. However, due to the cantilever structure, the durability of the lock arm is deteriorated and a space for largely bending the lock arm should be secured, so that the connector housing is enlarged.

SUMMARY

It is thereof an object of the present invention is to provide a connector that can be made to be smaller without lowering the durability and that can be smoothly locked and released to and from an opposite connector.

According to a first aspect of the embodiments of the present invention, there is provided a connector comprising: a housing configured to be inserted to and pulled out from an opposite connector housing; a lock arm connected at a leading end-side and a rear end-side of the housing, supported at both ends thereof along an insertion/pulling out direction with respect to the opposite connector housing and configured to be elastically deformable with the connection parts with the housing serving as fulcrums, and a locking claw formed at the lock arm and configured to be locked into a locking hole of the opposite connector housing when inserting the housing into the opposite connector housing, wherein the lock arm has a lock release part configured to release a locked state of the locking claw to the locking hole by being pressed toward the rear end-side of the housing beyond the locking claw, and wherein a position of the fulcrum at the rear end-side of the housing is arranged at an opposite side to a protruding direction of the locking claw, compared to a position of the fulcrum at the leading end-side of the housing.

In the connector having the above configuration, the fulcrum of the lock arm at the rear end-side of the housing is arranged at an opposite side to the protruding direction of the locking claw, compared to the fulcrum at the leading end-side of the housing. Hence, the pressing force applied to the lock release part is efficiently transferred to the lock arm without omission. Thereby, it is possible to release the locked state of the locking hole and the locking claw easily and smoothly. Furthermore, compared to a lock arm having a cantilever structure, it is possible to improve the durability and to make the housing smaller.

Also, since the rear end-side fulcrum of the lock arm 41 is arranged at the opposite side to the protruding direction of the locking claw, compared to the leading end-side fulcrum, it is possible to increase a deformation amount of the lock arm, compared to a configuration where the rear end-side fulcrum is flush with the leading end-side fulcrum. Hence, when locking the locking claw into the locking hole, it is possible to smoothly move the lock arm and to thus make a lock feeling, which is a touch feel upon the locking, favorable.

That is, it is possible to attempt the miniaturization without deteriorating the durability. Furthermore, it is possible to smoothly lock and release the connector and the opposite connector.

A line passing through the respective fulcrums of the lock arm may be arranged so as to be substantially perpendicular to a direction of a pressing force to be applied to the lock release part.

In the connector having the above configuration, the line passing through the respective fulcrums of the lock arm is arranged so as to be substantially perpendicular to a direction of a pressing force to be applied to the lock release part. Thus, when releasing the locked state of the locking claw and the locking hole, the lock release part is not applied with high force beyond necessity and the lock arm is easily and largely elastically-deformed and bent, so that it is possible to smoothly release the locked state.

According to the invention, it is possible to provide a connector that can be made to be smaller without lowering the durability and that can be smoothly locked and released to and from an opposite connector.

DETAILED DESCRIPTION OF THE EMBODIMENTS

Hereinafter, an illustrative embodiment of a connector of the invention will be described with reference to the drawings.

Figure 1:
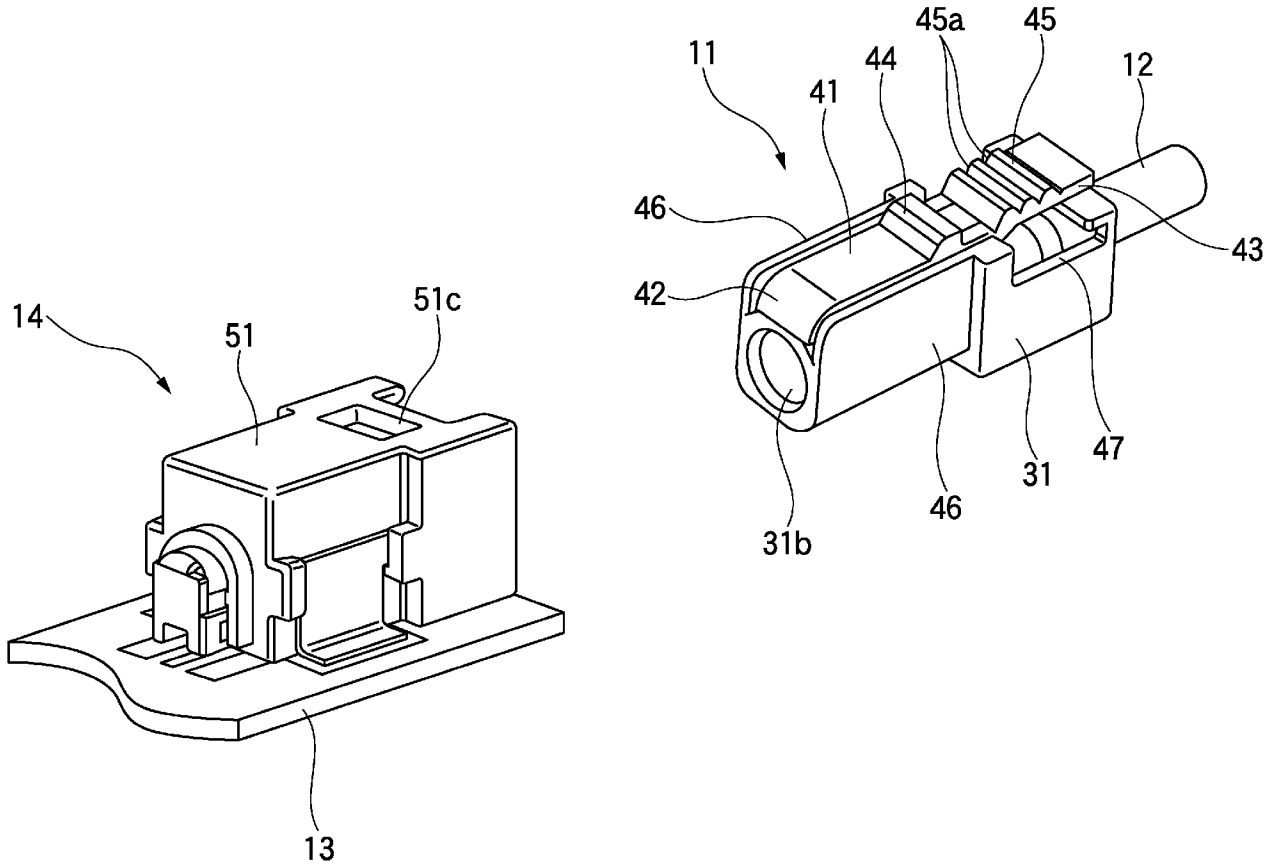
FIG. 1 is a perspective view of a cable-side connector according to an illustrative embodiment of the invention and a connector for a substrate to which the cable-side connector is connected.
Figure 2:
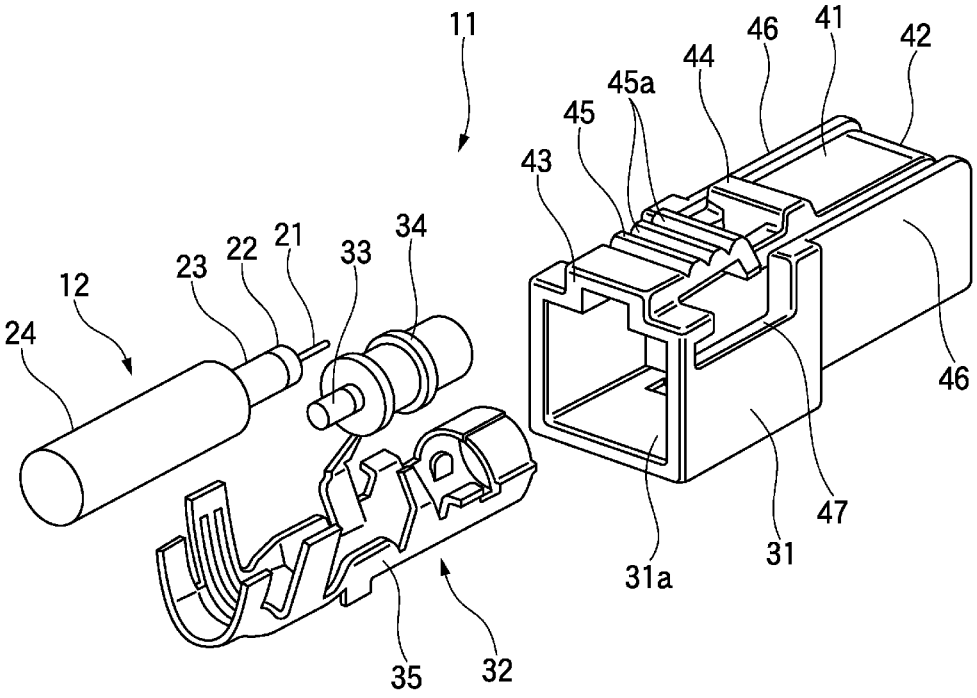
FIG. 2 is an exploded perspective view of the cable-side connector according to an illustrative embodiment of the invention.
Figure 3:
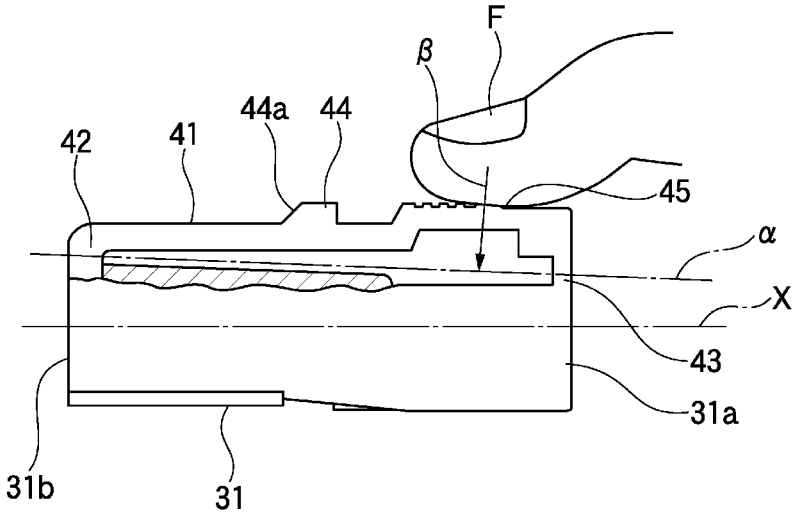
FIG. 3 is a side view of a housing of the cable-side connector according to an illustrative embodiment of the invention.
Figure 4:
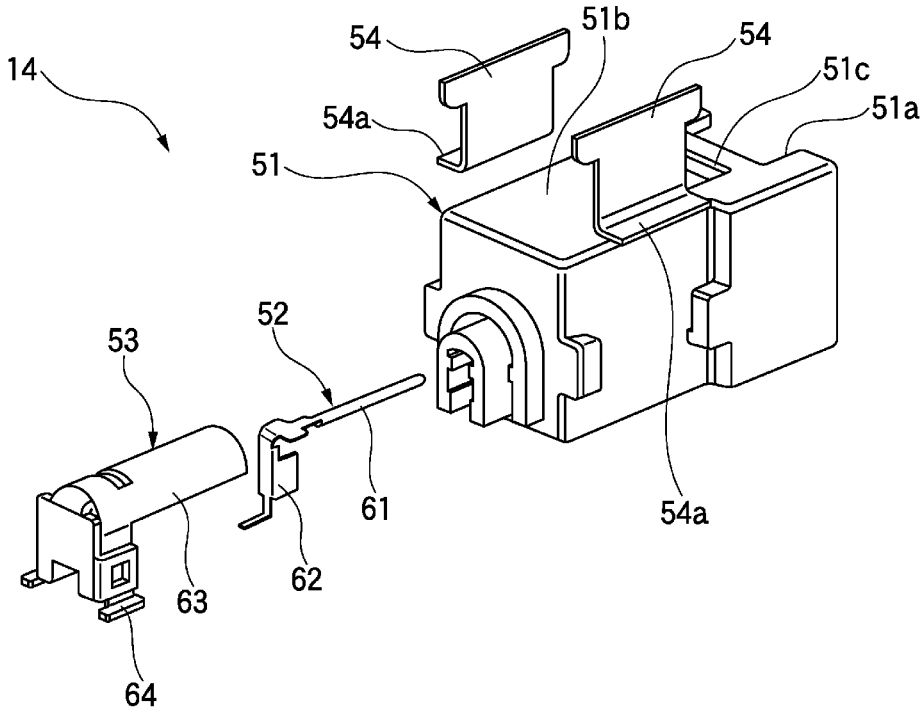
FIG. 4 is an exploded perspective view of the connector for a substrate to which the cable-side connector is connected.
Figure 5A:
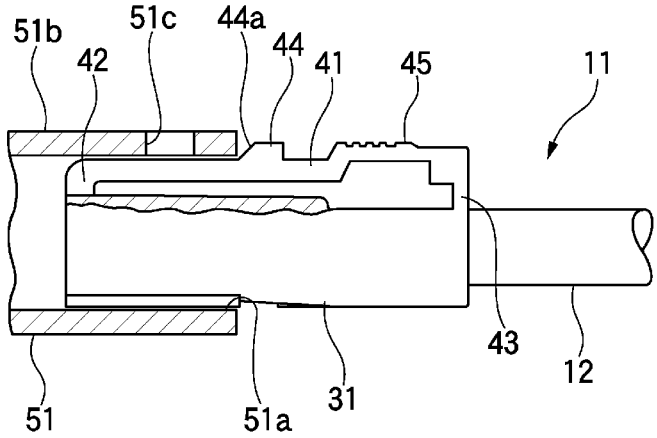
FIGS. 5A to 5C are schematic side sectional views illustrating movements that are made when the cable-side connector is inserted to and pulled out from the connector for a substrate.
Figure 5B:
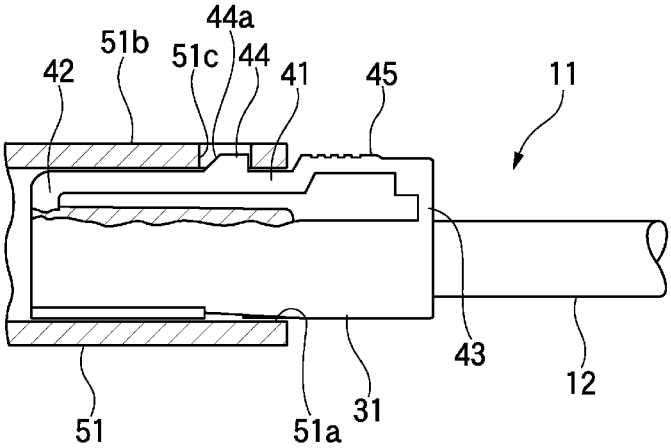
Figure 5C:
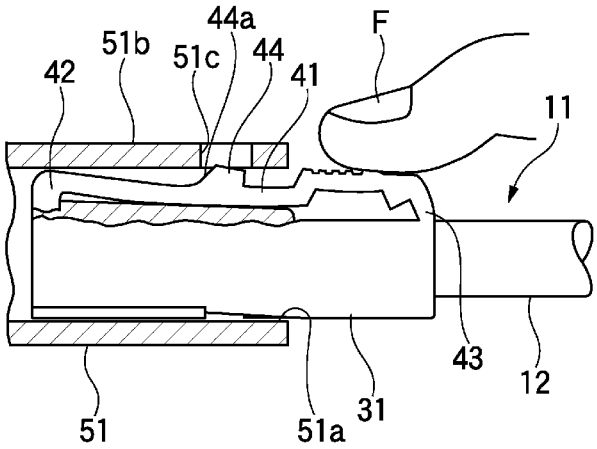

FIG. 1 is a perspective view of a cable-side connector according to an illustrative embodiment and a connector for a substrate to which the cable-side connector is connected, FIG. 2 is an exploded perspective view of the cable-side connector according to an illustrative embodiment, FIG. 3 is a side view of a housing of the cable-side connector according to an illustrative embodiment, FIG. 4 is an exploded perspective view of the connector for a substrate to which the cable-side connector is connected and FIGS. 5A to 5C are schematic side sectional views illustrating movements that are made when the cable-side connector is inserted to and pulled out from the connector for a substrate.

As shown in FIG. 1, a cable-side connector (connector) 11 according to an illustrative embodiment is a shielded connector that is attached to an end portion of a shielded cable 12. The cable-side connector 11 is connected to a connector 14 for a substrate, which is an opposite connector mounted on a circuit substrate 13 such as printed substrate.

As shown in FIG. 2, the shielded cable 12 to which the cable-side connector 11 is connected has a core wire 21, an insulation layer 22 that is extruded and covered onto the core wire 21, an outer conductor 23 that is provided around the insulation layer 22 and a sheath 24 that is covered around the outer conductor 23.

The cable-side connector 11 has a housing 31 made of synthetic resin, and a shielded terminal 32 is accommodated in the housing 31. The shielded terminal 32 has a cylindrical inner terminal 33 that is crimped and fixed to the core wire 21, an insulator 34 that is provided on an outer periphery of the inner terminal 33 and an outer terminal 35 that is provided on the outer periphery of the inner terminal 33 via the insulator 34 so that it is conductively connected to the outer conductor 23.

The housing 31 of the cable-side connector 11 is formed at its rear end-side with an opening 31*a*. The shielded terminal 32 is inserted and accommodated in the housing 31 through the opening 31*a*. Also, the housing 31 is formed at its leading end-side with a connection hole 31*b*. A leading end of the shielded terminal 32 is exposed to the connection hole 31*b*.

As shown in FIG. 3, the housing 31 is formed at its upper part with a lock arm 41. The lock arm 41 is a band plate that is provided from the leading end-side to the rear end-side of the housing 31 along a longitudinal direction of the housing 31, which is an insertion and pulling out direction to and from the connector 14 for a substrate, and is connected at the leading end-side and rear end-side of the housing 31. That is, the lock arm 41 is supported to both ends of the housing 31 at a leading end-side fulcrum (fulcrum) 42, which is a connection point of the leading end-side of the housing 31, and at a rear end-side fulcrum (fulcrum) 43, which is a connection point of the rear end-side of the housing 31, so that it is arranged at an interval on an upper surface of the housing 31.

The lock arm 41 is formed at an upper part of a central portion thereof with a locking claw 44 protruding upward. The locking claw 44 has a tapered guide surface 44*a* that is gradually inclined upward from the leading end-side of the housing 31 toward the rear end-side. Also, the lock arm 41 has a lock release part 45 at the rear end side of the housing 31, which is at the rear of the locking claw 44. The lock release part 45 is a part that an operator pushes with a finger F, and is formed at an upper surface thereof with a plurality of grooves 45*a* for slipping prevention along a width direction (refer to FIGS. 1 and 2).

In the lock arm 41, the rear end-side fulcrum 43 is arranged at an opposite side to the protruding direction of the locking claw 44, compared to the leading end-side fulcrum 42. In other words, the rear end-side fulcrum 43 is arranged farther away from the upper surface of the lock arm 41, compared to the leading end-side fulcrum 42. Thereby, a line $\alpha$ passing through the leading end-side fulcrum 42 and the rear end-side fulcrum 43 is inclined so that it becomes closer to a central axis line X from the leading end-side of the housing 31 toward the rear end-side.

Here, when the lock release part 45 is pushed with the finger F, the pressing force applied from the finger F is applied toward the inclined front side of the housing 31. The line $\alpha$ passing through the leading end-side fulcrum 42 and the rear end-side fulcrum 43 of the lock arm 41 is configured so as to be substantially perpendicular to a pressing direction $\beta$ of the pressing force to be applied toward the inclined front side at the lock release part 45.

As shown in FIGS. 1 and 2, the housing 31 has a protective wall 46 at the upper surface thereof, which is provided to erect along both sides of the lock arm 41. The protective wall 46 is formed with recesses 47 at both sides of the lock release part 45.

As shown in FIG. 4, the connector 14 for a substrate has a housing (opposite connector housing) 51 made of synthetic resin. The housing 51 is mounted with an inner conductor terminal 52 and an outer conductor terminal 53. Also, the housing 51 is mounted with L-shaped fixing pegs 54 at both sides thereof. Each of the fixing pegs 54 is provided at a lower end portion thereof with a fixing piece portion 54*a*. By fixing the fixing piece portions 54*a* to the circuit substrate 13 with a soldering and the like, the connector 14 for a substrate is attached to the circuit substrate 13.

The inner conductor terminal 52 has a connection pin portion 61 and a connection leg portion 62 that extends from a rear end of the connection pin portion 61 toward the circuit substrate 13 and is conductively connected to a conductor pattern (not shown) of the circuit substrate 13 by the soldering and the like.

The outer conductor terminal 53 has a terminal main body 63 having an arc shaped section and connection leg portions 64 that extend from a rear end of the terminal main body 63 toward the circuit substrate 13 and are conductively connected to the conductor pattern of the circuit substrate 13 by the soldering and the like.

The housing 51 is opened at its leading end-side. The cable-side connector 11 is connected to the opening 51*a*.

Also, the housing 51 is formed at its upper plate 51*b* with a locking hole 51*c* into which the locking claw 44 of the lock arm 41 provided to the housing 31 of the cable-side connector 11 can be locked.

In the below, operations of inserting and pulling out the cable-side connector 11 to and from the connector 14 for a substrate are described.

(Insertion Operation)

When the cable-side connector 11 is inserted into the opening 51*a* of the connector 14 for a substrate, the guide surface 44*a* of the locking claw 44 is brought into contact with an opening edge of the housing 51 of the connector 14 for a substrate, as shown in FIG. 5A. At this state, when the cable-side connector 11 is further inserted, the guide surface 44*a* and the opening edge of the housing 51 are slidingly contacted each other, so that the pressing force facing the housing 31 is generated in the locking claw 44. Therefore, the lock arm 41 is elastically deformed, so that the locking claw 44 is pushed down toward the housing 31 and is thus pushed in the housing 51.

When the cable-side connector 11 is further inserted and thus the locking claw 44 reaches the locking hole 51*c* of the housing 51, the elastically deformed lock arm 41 is restored, so that the locking claw 44 is introduced into the locking hole 51*c*, as shown in FIG. 5B. Thereby, the housing 31 of the cable-side connector 11 is locked with the housing 51 of the connector 14 for a substrate, so that the connector 14 for a substrate and the cable-side connector 11 are connected to each other.

Thus, the connection pin portion 61 of the inner conductor terminal 52 of the connector 14 for a substrate is inserted and conductively connected to the inner terminal 33 of the cable-side connector 11 and the outer terminal 35 of the cable-side connector 11 is introduced into the terminal main body 63 of the outer conductor terminal 53 of the connector 14 for a substrate, so that the outer terminal 35 and the outer conductor terminal 53 are conductively connected.

At this time, since the rear end-side fulcrum 43 of the lock arm 41 is arranged at an opposite side to the protruding direction of the locking claw 44, compared to the leading end-side fulcrum 42, a deformation amount of the lock arm 41 is increased, compared to a configuration where the rear end-side fulcrum 43 is flush with the leading end-side fulcrum 42. Thereby, when inserting the cable-side connector 11 into the connector 14 for a substrate and locking the locking claw 44 into the locking hole 51*c*, the lock arm 41 is smoothly moved and a touching feel upon the locking becomes favorable.

(Pulling Out Operation)

In order to pull out the cable-side connector 11 from the connector 14 for a substrate and to thus release the connection, an operator pushes the lock release part 45 of the lock arm 41 of the cable-side connector 11 with the finger F, as shown in FIG. 5C. By doing so, the lock arm 41 is elastically deformed by the pressing force to the lock release part 45, so that the locking claw 44 is pushed down toward the housing 41 and is thus pulled out from the locking hole 51*c* of the housing 51. Thereby, the locked state of the cable-side connector 11 relative to the housing 51 of the connector 14 for a substrate is released.

Here, the rear end-side fulcrum 43 of the lock arm 41 is arranged at the opposite side to the protruding direction of the locking claw 44, compared to the leading end-side fulcrum 42, and the line α passing through the leading end-side fulcrum 42 and the rear end-side fulcrum 43 is inclined so that it becomes closer to the central axis line X from the leading end-side of the housing 31 toward the rear end-side and is configured so as to be substantially perpendicular to the pressing direction β of the pressing force from the finger F to be applied toward the inclined front side at the lock release part 45.

Accordingly, the pressing force applied to the lock release part 45 is efficiently transferred to the lock arm 41 without omission. Thus, the lock release part 45 is not applied with high force beyond necessity and the lock arm 41 is easily and largely elastically-deformed and bent, so that it is possible to smoothly release the locked state.

Also, since the lock release part 45 is formed at both sides with the recesses 47, it is possible to smoothly press the lock release part 45.

After the locked state of the locking claw 44 and the locking hole 51*c* is released, as described above, the cable-side connector 11 is pulled forward with respect to the connector 14 for a substrate, so that the cable-side connector 11 is pulled out from the connector 14 for a substrate.

Like this, according to the illustrative embodiment, since the rear end-side fulcrum 43 of the lock arm 41 is arranged at the opposite side to the protruding direction of the locking claw 44, compared to the leading end-side fulcrum 42, the pressing force applied to the lock release part 45 is efficiently transferred to the lock arm 41 without omission. Thereby, it is possible to release the locked state of the locking claw 44 and the locking hole 51*c* easily and smoothly. Furthermore, compared to a lock arm having a cantilever structure, it is possible to improve the durability and to make the housing smaller. Thus, it is possible to provide a connector that can be suitably used for a radio amplifier, a television amplifier, a navigation and the like.

Also, since the rear end-side fulcrum 43 of the lock arm 41 is arranged at the opposite side to the protruding direction of the locking claw 44, compared to the leading end-side fulcrum 42, it is possible to increase the deformation amount of the lock arm 41, compared to a configuration where the rear end-side fulcrum 43 is flush with the leading end-side fulcrum 42. Hence, when locking the locking claw 44 into the locking hole 51*c*, it is possible to smoothly move the lock arm 41 and to thus make a lock feeling, which is a touch feel upon the locking, favorable.

That is, it is possible to attempt the miniaturization without deteriorating the durability. Furthermore, it is possible to smoothly lock and release the cable-side connector and the connector 14 for a substrate that is an opposite connector.

In particular, the line α passing through the leading end-side fulcrum 42 and the rear end-side fulcrum 43 is arranged so as to be substantially perpendicular to the pressing direction β of the pressing force to be applied toward the lock release part 45. Hence, when releasing the locked state of the locking claw 44 and the locking hole 51*c*, the lock release part 45 is not applied with the high force beyond necessity and the lock arm 41 is easily and largely elastically-deformed and bent, so that it is possible to smoothly release the locked state Here, reference examples are described so as to explain the other merits of the invention.

Figure 6:
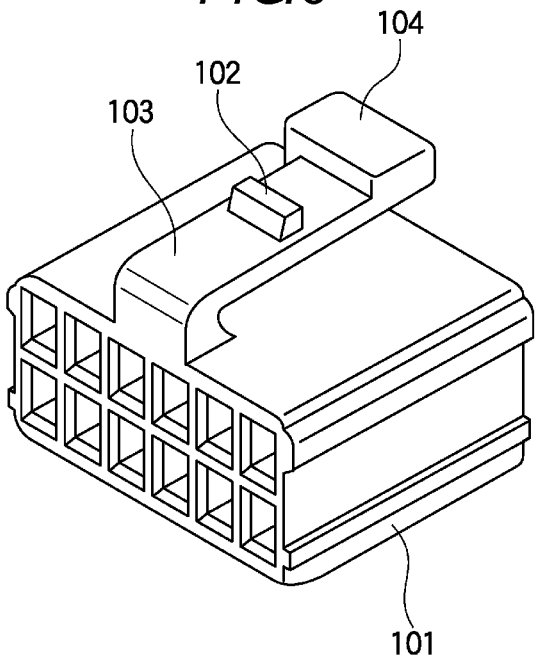
FIG. 6 is a perspective view of a connector of a reference example.
Figure 7A:
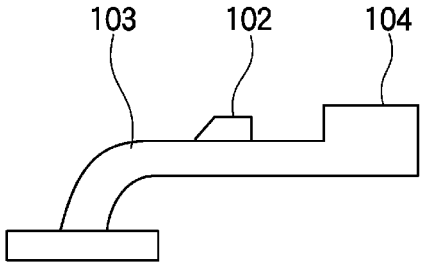
FIGS. 7A and 7B are schematic side views showing a lock arm of the connector of the reference example.
Figure 7B:
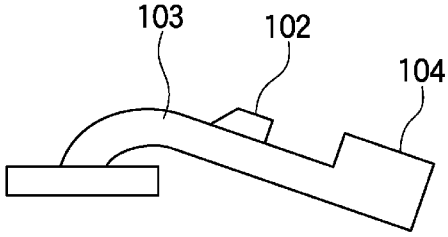
Figure 8:
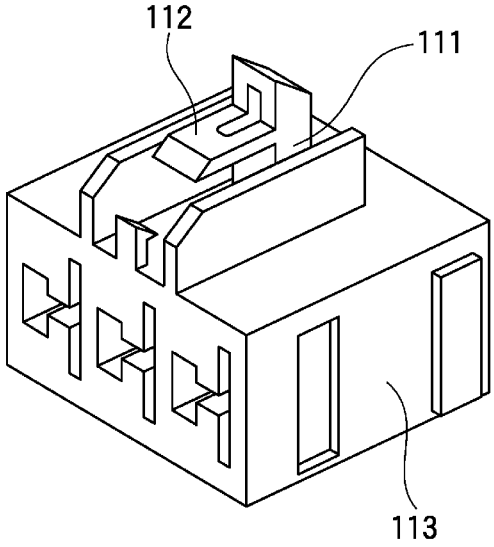
FIG. 8 is a perspective view of a connector of another reference example.
Figure 9:
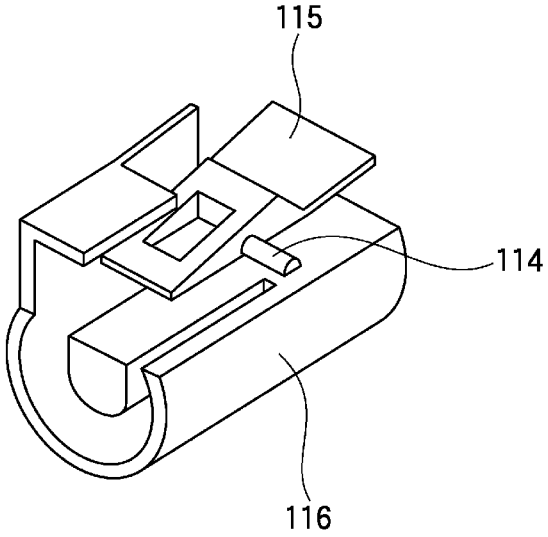
FIG. 9 is a perspective view of a connector of another reference example.
Figure 10:
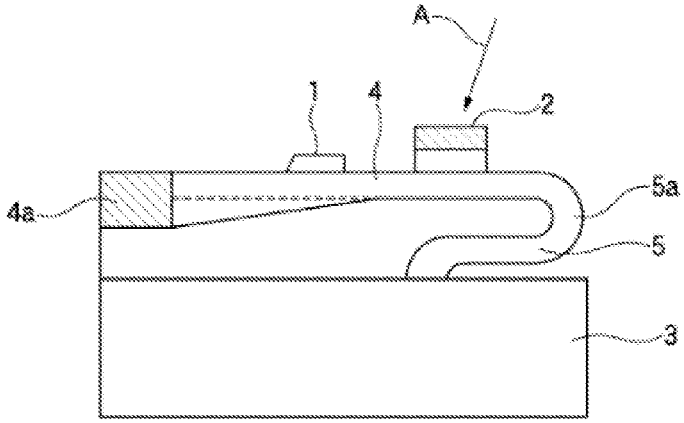
FIG.10 (CONVENTIONAL ART)
FIG. 10 is a schematic side sectional view showing a structure of a connector according to the prior art.
Figure 11:
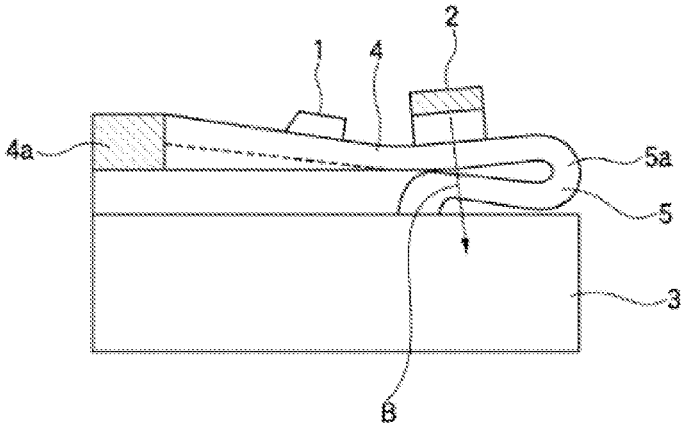
FIG.11 (CONVENTIONAL ART)
FIG. 11 is a schematic side sectional view showing the structure of the connector according to the prior art.

FIG. 6 is a perspective view of a connector of a reference example, FIGS. 7A and 7B are schematic side view showing a lock arm of the connector of the reference example and FIGS. 8 and 9 are perspective views of connectors of the other reference examples.

As shown in FIGS. 6 and 7A, a housing 101 of a connector has a lock arm 103 having a locking claw 102 that can be locked into a locking hole of an opposite connector. The lock arm 103 has a cantilever structure where it is connected to a leading end-side of the housing, and is provided at its rear end-side with a lock release part 104 that is pressed by a finger.

As shown in FIG. 7B, according to the lock arm 103 having the cantilever structure, when the lock release part 104 is pressed, the lock arm is easily elastically-deformed, thereby releasing a locked state of the locking hole and the locking claw 44. However, due to the cantilever structure where the lock arm 103 is connected at its leading end only, the durability is deteriorated and a space for largely bending the lock arm should be secured. Hence, the housing 101 should be enlarged so as to avoid an interference with the inner terminal, so that a size of the connector is inevitably increased.

Also, FIG. 8 shows a front lock-type connector in which a lock arm 112, which oscillates about a rear end side thereof serving as a fulcrum 111, is provided on an upper part of a housing 113. FIG. 9 shows a seesaw lock-type connector in which a lock arm 115, which oscillates about a central portion thereof serving as a fulcrum 114, is provided on an upper part of a housing 116.

Since the front lock-type connector or seesaw lock-type connector has a structure that oscillates the lock arm 112, 115 about the fulcrum 111, 114, the durability is low and the size thereof is increased.

In the meantime, the invention is not limited to the above illustrative embodiment. The above illustrative embodiment can be appropriately modified and improved. The materials, shapes, sizes, the number, arrangement positions and the like of the respective constitutional elements in the illustrative embodiment are arbitrary and are not particularly limited insomuch as they can achieve the invention. As shown in FIG. 3, the lock arm 41 of the housing 31 is configured so that the upper surface of the lock release part 45 is parallel with the central axis line X. However, the upper surface of the lock release part 45 may be parallel with the line $\alpha$ passing through the leading end-side fulcrum 42 and the rear end-side fulcrum 43. That is, the upper surface of the lock release part 45 may be inclined relative to the central axis line X. Thereby, since it is possible to restrain the direction of the pressing force from the finger when releasing the locked state in a constant direction, regardless of the shape of the finger of the operator, it is possible to securely make the line $\alpha$ passing through the leading end-side fulcrum 42 and the rear end-side fulcrum 43 perpendicular to the pressing direction $\beta$. As a result, when releasing the locked state of the locking claw 44 and the locking hole 51*c*, the lock release part 45 is not applied with the high force beyond necessity and the lock arm 41 is easily and largely elastically-deformed and bent, so that it is possible to smoothly release the locked state.

What is claimed is:

1. A connector comprising:

a housing configured to be inserted to and pulled out from an opposite connector housing;

a lock arm connected at a leading end-side and a rear end-side of the housing, supported at both ends thereof along an insertion/pulling out direction with respect to the opposite connector housing and configured to be elastically deformable with the connection parts with the housing serving as fulcrums, the lock arm including an upper surface and a locking claw formed at the upper surface of the lock arm and configured to be locked into a locking hole of the opposite connector housing when inserting the housing into the opposite connector housing, wherein the lock arm has a lock release part configured to release a locked state of the locking claw to the locking hole by being pressed and disposed at a position closer to the rear end-side of the housing than the locking claw, and wherein the fulcrum at the rear end-side of the housing is arranged further away from the upper surface of the lock arm compared to the fulcrum at the leading end-side of the housing.

2. The connector according to claim 1, wherein a line passing through the respective fulcrums of the lock arm is arranged so as to be substantially perpendicular to a direction of a pressing force to be applied to the lock release part.

3. The connector according to claim 1, wherein a distance between a fulcrum line passing through the fulcrums and a central axis line of the housing becomes smaller as a position on the fulcrum line gets closer to the rear-end side.

* * * * *